US007207468B2

(12) United States Patent
Cohen et al.

(10) Patent No.: US 7,207,468 B2
(45) Date of Patent: Apr. 24, 2007

(54) MICRODISPENSING PUMP

(75) Inventors: Ben Z. Cohen, 140 E. 80th St., New York, NY (US) 10021; Nigel Kelly, Rye, NY (US)

(73) Assignee: Ben Z. Cohen, New York, NY (US)

( * ) Notice: Subject to any disclaimer, the term of this patent is extended or adjusted under 35 U.S.C. 154(b) by 0 days.

(21) Appl. No.: 11/296,974

(22) Filed: Dec. 8, 2005

(65) Prior Publication Data

US 2006/0086760 A1 Apr. 27, 2006

Related U.S. Application Data

(62) Division of application No. 10/069,682, filed as application No. PCT/US00/23206 on Aug. 23, 2000, now Pat. No. 7,014,068.

(60) Provisional application No. 60/150,405, filed on Aug. 23, 1999.

(51) Int. Cl.
*B65D 88/54* (2006.01)

(52) U.S. Cl. ..... 222/321.9

(58) Field of Classification Search ..... 222/321.9
See application file for complete search history.

(56) References Cited

U.S. PATENT DOCUMENTS 3,352,463 A 11/1967 Berler
3,618,829 A 11/1971 Elmore et al.
3,949,906 A 4/1976 Pettersen et al.
4,072,249 A 2/1978 Ekenstam et al.
4,787,536 A 11/1988 Widerstrom
4,795,063 A 1/1989 Sekiguchi et al.
5,062,549 A 11/1991 Smith et al.
5,337,924 A 8/1994 Dickie
5,360,145 A 11/1994 Gueret
5,381,932 A 1/1995 Humphrey
5,388,727 A 2/1995 Jouillat
5,636,765 A 6/1997 DeJonge
5,649,648 A 7/1997 Lier et al.

(Continued)

OTHER PUBLICATIONS

International Preliminary Examination Report from International Application No. PCT/US00/23206 filed on Aug. 23, 2000.

*Primary Examiner*—Philippe Derakshani
(74) *Attorney, Agent, or Firm*—Hoffmann & Baron, LLP

(57) ABSTRACT

A pre-compression pump (10) dispenses microdoses of fluid (F). The pump minimizes pulsing due to pressure fluctuations. The pump is provided with the following to limit pulsing: a low force slow return velocity return spring (46); enlarged fluid passage (58); elastic bumper (74); and, a rachet tooth (76) bearing against the stem (44). Further, a deflectable diaphragm (90), a splined (70) stem (44), no dip tube, and an off-center, gravitational low-point pump inlet (62) assist in printing the pump. The pump includes a stem (44) with deflectable fingers (92) to ensure sufficient momentum in pump operation. Detents (118) and grooves (120) selectively lock a nozzle cap (14) in an inoperative position. To ensure cleanliness, nozzle (60) cleaning is provided, wiping of the nozzle to remove meniscus (M) therefrom, cuts (104) formed in a shroud (98) assist in drawing excess fluid from the nozzle, and an empty volume (108) for collecting fluid run-off from the nozzle. A handle (H) is mounted to the pump providing a grip.

7 Claims, 10 Drawing Sheets

U.S. PATENT DOCUMENTS

| | | | | |
|---|---|---|---|---|
| 5,772,079 | A | 6/1998 | Gueret | |
| 5,806,721 | A | 9/1998 | Tada | |
| 5,850,948 | A | 12/1998 | Garcia et al. | |
| 5,918,774 | A | 7/1999 | Lund et al. | |
| 6,062,430 | A | 5/2000 | Fuchs | |
| 6,073,805 | A | 6/2000 | Gueret | |
| 6,126,038 | A | 10/2000 | Olegnowicz | |
| 7,014,068 | B1 * | 3/2006 | Cohen et al. | 222/321.9 |

* cited by examiner

MICRODISPENSING PUMP

This application is a division of U.S. application Ser. No. 10/069,682, filed Mar. 7, 2002, now U.S. Pat. No. 7,014,068 which is a §371 application of PCT Application No. PCT/US00/23206, filed Aug. 23, 2000, which claims priority of U.S. Provisional Patent Application Serial No. 60/150,405 filed Aug. 23, 1999.

This invention relates to pumps for dispensing fluids and medications, and, more particularly, to microdispensing pumps.

In the prior art, positive displacement and pre-compression pumps are known. In addition, U.S. Pat. No. 5,881,956, to the inventors herein, discloses a positive displacement pump which is capable of dispensing microdoses of fluid, as small as 5–10 microliters. U.S. Pat. No. 5,881,956 is incorporated by reference herein. With such small dosing capability, the pumps of U.S. Pat. No. 5,881,956 are advantageously usable to dispense opthalthmic medication. Although some of the teachings of U.S. Pat. No. 5,881,956 can be applied to the pre-compression pump art, there are significant differences between the pumps which prevent full carry-over of the technology.

A pre-compression pump operates on the principle that the pressure build-up within a pump cylinder propels a fluid out of the pump. The ejection of the fluid drains the pump cylinder thereby causing a pressure differential which results in additional fluid being drawn into the pump cylinder. In contrast, a positive displacement pump relies on one dose of fluid literally "pushing" out, and thus causing ejection of, a preceding dose of fluid.

As can be appreciated, the consistent dispensing of microdoses (5–10 microliters) of fluid presents a unique set of problems. The problems of priming pumps with such small doses with positive displacement pumps are addressed in U.S. Pat. No. 5,881,956. Because of the difference in operating principles between positive displacement pumps and pre-compression pumps, the disclosure of the aforementioned patent can not be fully applied to pre-compression pumps to achieve microdosing of 5–10 microliters. For example, it has been found that fluids generally pulse upon dispensing from a pre-compression pump because of pressure fluctuations, the pulsing action resulting in atomization of the dispensed fluid. Particularly, pressure fluctuations are generated during pump operation, where a pressure build-up within the cylinder of the pump causes the stem of the pump to separate from the piston, thereby allowing pressurized fluid to rush into, and out of, the nozzle of the pump. However, upon initial separation of the stem from the piston, the pressure within the cylinder quickly decays, with the stem being urged back into sealing contact with the piston by a return spring. The fluid is then quickly re-pressurized in the cylinder, again causing separation of the stem from the piston, thus, achieving further fluid delivery. This repeated "opening" and "closing" of the pump cylinder occurs rapidly with the dose being continuously and interruptedly delivered. The internal pressure of the dose, however, fluctuates as it is dispensed causing the dispensed fluid to pulse.

With typical uses of pre-compression pumps, pulsing does not interfere with the required atomization of the dispensed liquid. Typical doses are relatively large, and, thus, are substantially insensitive to the pressure fluctuations; pre-compression pumps generally dispense doses much larger than 10 microliters, with such doses being on the order of at least 70 microliters. Where it is desired to consistently dispense microdoses of fluid without atomization, such as with ophthalmic medication, pressure fluctuations have an adverse effect. Furthermore, medication is ideally delivered in a stable, relatively laminar flow pattern, with little pressure fluctuation throughout dosage delivery. Atomization of the fluid is not desired.

Accordingly, it is an object of the subject application to provide a pre-compression pump capable of consistently dispensing repeated microdoses of fluid and medication without atomization.

SUMMARY OF THE INVENTION

The aforementioned object is met by a pre-compression pump having various inventive features. It should be noted that some of the features can be carried over to other pump arts beyond the field of pre-compression pumps, such as lift pumps.

In a first aspect of the invention, the pump includes features to minimize the pulsing effect caused by pressure fluctuations in a pre-compression pump, thereby avoiding atomization in dispensing a fluid. Specifically, the pump is provided with various elements which restrict the responsive movement of the stem so that the stem does not quickly respond to the pressure fluctuations in the pump cylinder. Accordingly, the stem will respond relatively slowly to the decay of internal pressure of the cylinder, thereby prolonging the uninterrupted delivery of fluid without pulsing and allowing for a laminar delivery. First, a return spring is provided to urge components into a rest position which is formed with a low spring force and/or is wound to have a slow return velocity (typical coil springs are wound to have high return velocities). Accordingly, the spring will react weakly/slowly to pressure decay within the pump cylinder with the stem being urged into a closed position relatively slowly as compared to the rate of pressure decay. Second, portions of the fluid passage communicating the pump cylinder and the nozzle are enlarged so as to reduce restriction to flow, thereby minimizing throttling of the fluid, and to provide a damping effect on the fluid. The reduction in throttling and the damping effect coact to reduce pulsing in the fluid. Third, an elastically-deformable bumper may be disposed on the end of the stem of the pump. The bumper, which may be in the form of a deflectable dome or a solid member, is disposed on an end of the stem so as to absorb, and react to, pressure of the fluid, thereby minimizing the stem's reaction to fluid pressure. Fourth, an internal seal may be formed with a generally triangular cross-section to increase fluid drag on the stem and further inhibit movement of the stem. Fifth, a ratchet tooth may be disposed on the pump piston which bears against the stem and inhibits movement of the stem, thereby also reducing the stem's reaction to fluid pressure.

In addition, in a second aspect of the invention, priming of the pump is a concern, since a relatively minor air pocket will inhibit, or altogether prevent, the ability of the pump to dispense microdoses. To aid in proper priming, a partially splined stem is preferably used, wherein shallow recesses are formed between the splines. The recesses are sufficiently shallow such that air bubbles may pass between the splines via the recesses, but un-pressurized fluid will not because of its viscosity. As such, air bubbles may escape without hindering operation of the pump. Also no dip tube is utilized, thereby eliminating the possibility of an air pocket being trapped in the dip tube. During priming of a pump with a dip tube, a sufficient amount of fluid must be drawn from the dip tube to ensure no air pockets are therein. Air pockets are compressible and inhibit, or defeat, continuous operation of a pump. Without a dip tube, an inlet is formed in the pump cylinder which is in direct communication with the fluid reservoir of the pump. Preferably, the inlet is located off-center in the pump cylinder and at a low point on a tapered surface. With the off-set location and tapered surface, air bubbles will not become entrapped at the bottom of the cylinder, and the air bubbles will have an unobstructed path up along the outside of the pump cylinder to escape the pump. In addition, a deflectable diaphragm may be provided which is deflectable into the fluid reservoir to reduce the volume thereof.

Furthermore, in a third aspect of the invention, the pump includes a stem formed with deflectable fingers that yield under a pre-determined amount of operational force thereby ensuring sufficient momentum is provided in operating the pump. In this manner, the pump can only be operated with sufficient force to ensure full and proper fluid dispensing.

In a fourth aspect of the invention, cleanliness of the pump is of concern. Cooperative detents and grooves are formed to selectively lock the nozzle cap in an inoperative, locked position. In a locked position, the nozzle of the pump is covered by a shroud which prevents dirt and debris from collecting on the nozzle. The nozzle cap and shroud are preferably formed with cooperating members which overlap in a locked position to form a seal in proximity to the nozzle to further inhibit the ingress of dirt and debris between the shroud and nozzle cap. The pump also provides for cleaning of the nozzle, with an opening in the shroud wiping the nozzle to remove any meniscus therefrom after dispensing fluid. Additionally, cuts are formed in the shroud facing the nozzle cap which assist in drawing excess fluid from the nozzle, and an empty void is located about the nozzle for collecting fluid run-off from the nozzle.

In a fifth aspect of the invention, a handle is also mounted to the pump to provide a comfortable grip for handling the pump.

These and other features of the invention will be better understood through a study of the following detailed description and accompanying drawings.

DETAILED DESCRIPTION OF THE INVENTION

Figure 1:
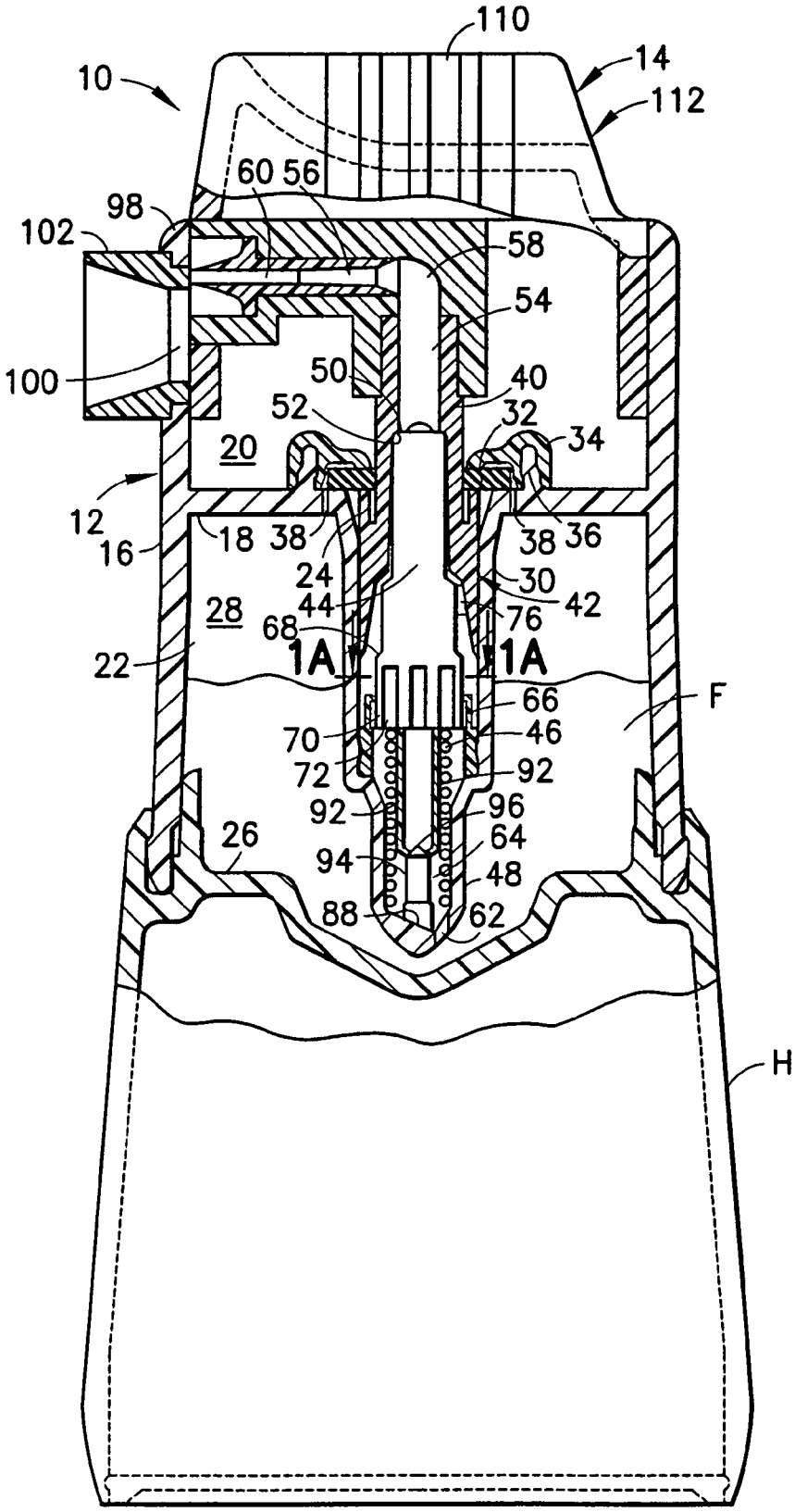
FIG. 1 is an elevational view of a pump in accordance with the subject invention.
Figure 1A:
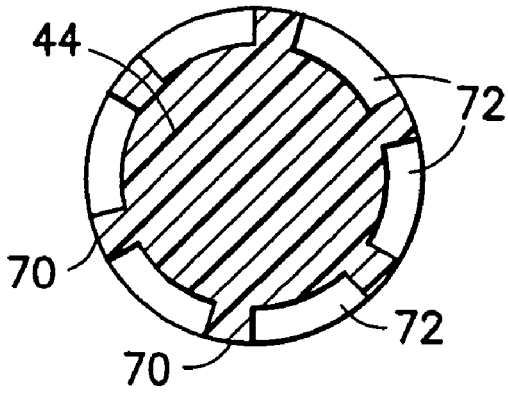
FIG. 1A is a cross-sectional view taken along line 1A—1A of FIG. 1.
Figure 4A:
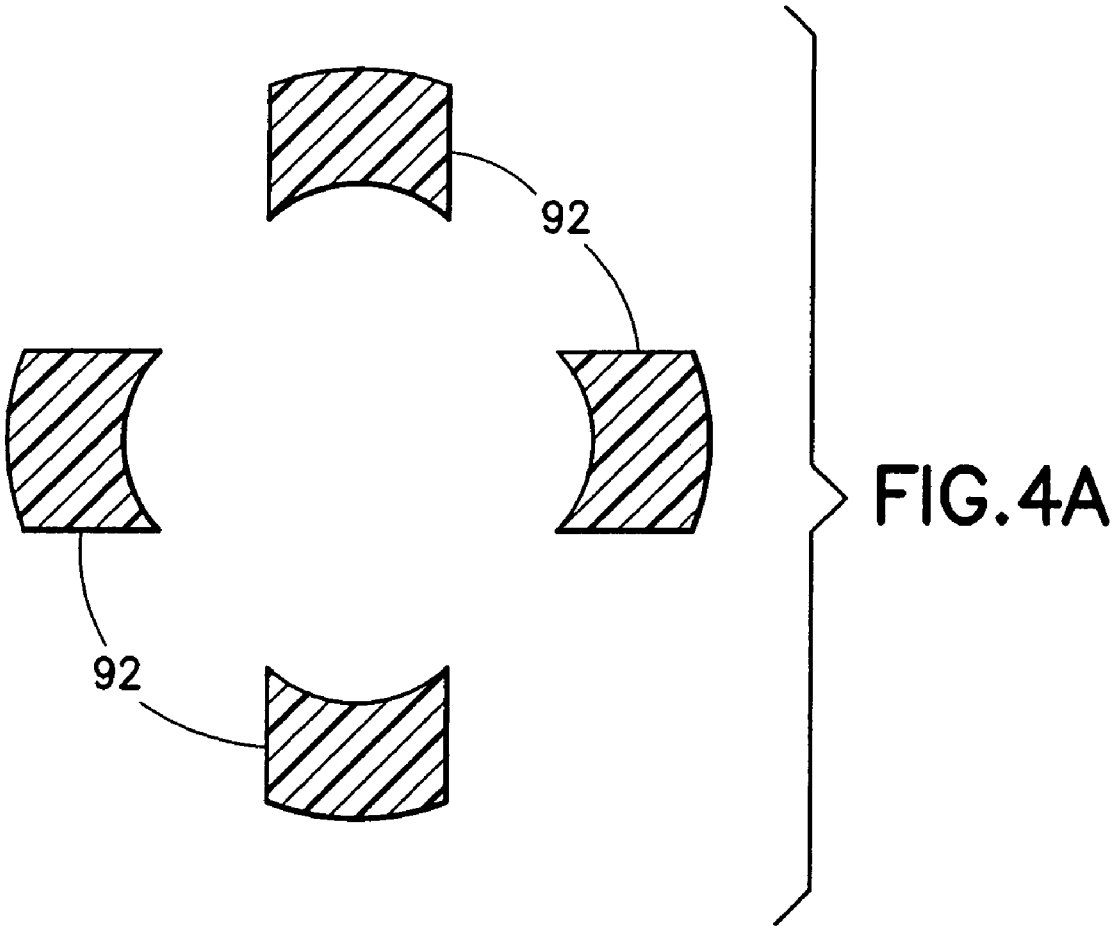
FIG. 4A is a cross-sectional view taken along line 4A—4A.

Referring to the FIGS., a pre-compression pump 10 is shown, along with various features thereof. The pump 10 generally includes a body 12, and a nozzle cap 14.

The body 12 is formed with a generally tubular outer wall 16 with a transverse web 18 which divides the body 12 into two chambers, an upper chamber 20 and a lower chamber 22, and a web opening 24 communicates the two chambers 20 and 22. The nozzle cap 14 is disposed in the upper chamber 20, whereas, the lower chamber 22 cooperates with a bottom wall 26 to define fluid reservoir 28. The bottom wall 26 may be detachable from the outer wall 16 so as to permit charging of fluid directly into the fluid reservoir 28.

A tubular cylinder 30 is mounted about the web opening 24 and extends into the fluid reservoir 28. As shown in FIG. 1, a rubber washer 32 is disposed over, and presses against, the cylinder 30. A holding member 34, disposed to engage and hold the rubber washer 32, is preferably snap-fitted onto an annular ridge 36 protruding from the web 18. Also, vent holes 38 extend through the web 18. It is preferred that the vent holes 38 be out of contact with the rubber washer 32, so that air may be drawn through the web 18 and into the fluid reservoir 28 during use.

A tubular piston 40 is disposed within the cylinder 30 and extends therefrom through the rubber washer 32 and into the upper chamber 20. The rubber washer 32 is generally circumferentially in contact with, and forms a seal about, the piston 40. In addition, the piston 40 has an outer surface 42 which is in contact with the cylinder 30, due to an interference fit being defined therebetween. It must be noted however that the interference fit may not be excessive since the piston 40 must be slidable relative to the cylinder 30. In addition the nozzle cap 14 is mounted onto the piston 40 such that the two elements move together.

A cylindrical stem 44 is disposed within the cylinder 30 and partially telescoped within the piston 40. The stem 44 is slidable relative to both the cylinder 30 and the piston 40. Additionally, the stem 44 is urged into contact with the piston 40 by a return spring 46 disposed between the stem 44 and lower end 48 of the cylinder 30. The interaction of top edge 50 of the stem 44 and lip 52 of the piston 40 limits the upward movement of the stem 44.

A fluid passage 54 is defined in the piston 40 about the stem 44 and above the lip 52. The fluid passage 54 is in fluid communication with passage 56 formed in the nozzle cap 14. The passage 56 has a bend 58 which re-directs the passage 56 to nozzle 60.

In operation, fluid F is disposed within the fluid reservoir 28. With the pump 10 being fully primed, the fluid F is also present within the cylinder 30. An inlet 62 is formed in the lower end 48 which communicates cylinder chamber 64, encompassed by the cylinder 30, and the fluid reservoir 28. An annular seal 66 is mounted within the cylinder chamber 64 so as to form a seal about the stem 44. Upon depressing the nozzle cap 14, the piston 40 is translated downwardly, pressing against the top edge 50 of the stem 44 and against the spring force of the return spring 46. As the piston 40 and the stem 44 move downwardly, the volume of the cylinder chamber 64 above the annular seal 66 decreases, thereby increasing the pressure of the fluid F trapped therein. The pressure of the fluid F acts on all surfaces in contact with the fluid F, including a tapered actuating surface 68. With further downward movement, the pressure of the fluid F increases to the point where the fluid F presses down on the actuating surface 68 so as to separate the top edge 50 of the stem from the lip 52 of the piston 40. The pressurized fluid F then escapes from the cylinder chamber 64 through the fluid passage 54, into the passage 56, and out of the nozzle 60. As the fluid F escapes, the internal pressure of the cylinder chamber 64 decays. The phenomenon of pressure fluctuations described above take effect with the fluid F being dispensed from the nozzle 60. With the pressure within the cylinder chamber 64 being sufficiently decayed the stem 44 is urged into contact with the piston 40.

The stem 44 is formed with a plurality of longitudinally extending splines 70 which separate recesses 72. When pressurizing the cylinder chamber 64 during pumping, the splines 70 are located below the seal 66 with the annular seal 66 generally sealing a full circumference of the stem 44. In this manner, no fluid F by-passes the seal 66. With the further decrease in pressure in the cylinder chamber 64, a pressure differential is created across the annular seal 66, the stem 44 is urged toward the piston 40, and the fluid F is drawn into the cylinder chamber 66 through the recesses 72 under the annular seal 66. Consequently, the pump 10 is re-charged, and ready for re-use.

The description above generally describes the operation of the pump 10. Below are various features which elaborate upon different aspects of the invention.

Reduction of Fluid Pulsing

Various features are provided to minimize pressure fluctuations, in repeated opening and closing of the pump 10 during operation, to avoid repeated engagement and disengagement of the top edge 50 of the stem 44 and the lip 52 of the piston 40. Accordingly, non-atomized microdoses of fluid may be delivered. First, the interference fit between the piston 40 and the cylinder 30 is reduced from that found in the prior art. Typically, the interference fit is approximately 0.010 inches. With the subject invention, the interference fit is approximately 0.005 inches. Accordingly, the return spring 46 can be formed with a weaker spring force than that in the prior art, since less resistance is presented by the interference fit, and/or the return spring 46 can be wound to have a slower return velocity than that found in the prior art. In either regard, the weaker/slower response of the return spring 46 will retard the spring's response to pressure decay in the cylinder chamber 64. With the return spring 46 responding weakly/slowly, the stem 44 will not engage and disengage the piston 40 as repeatedly in the prior art.

Figure 2:
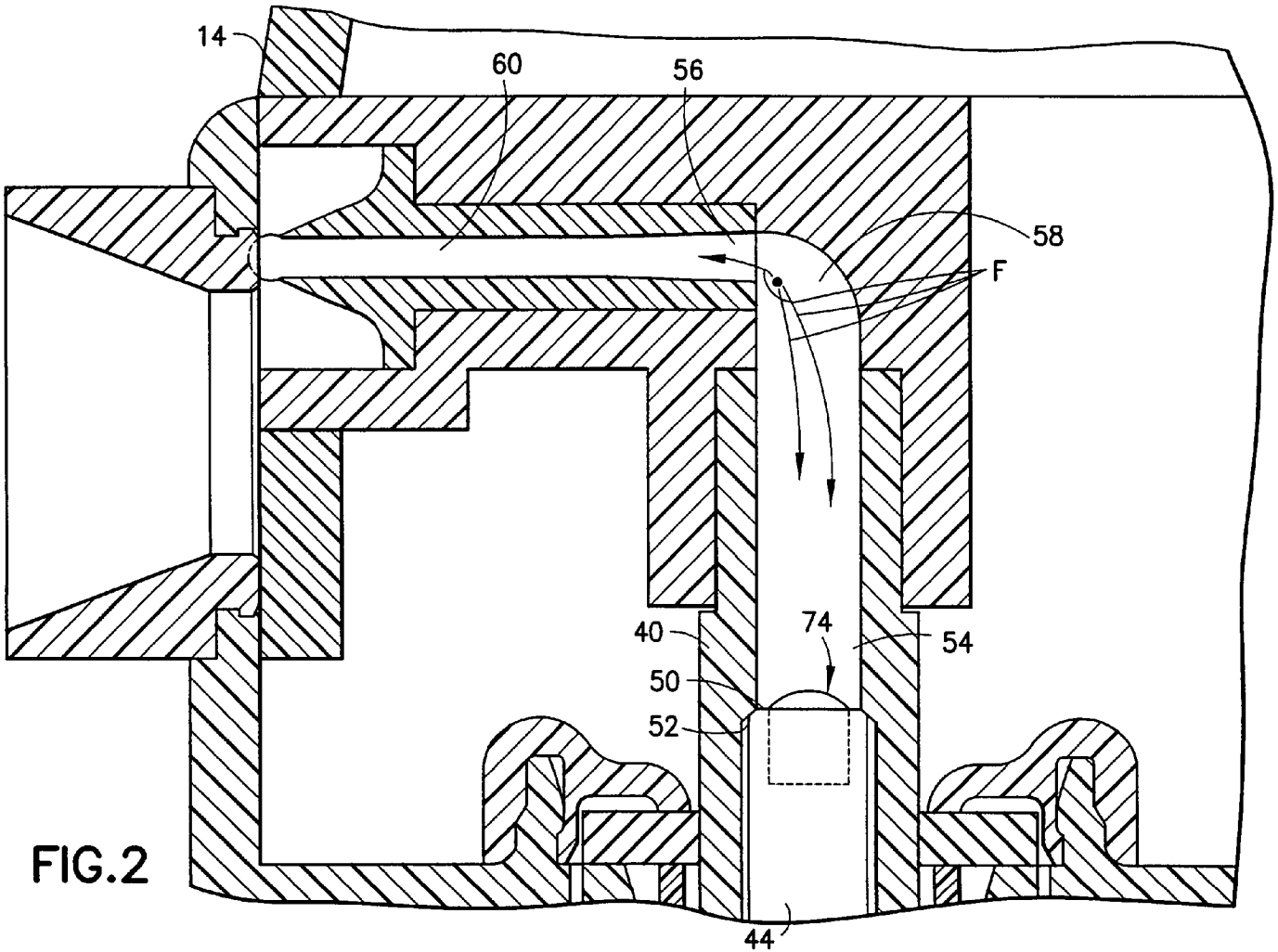
FIG. 2 is an enlarged view of the nozzle of the pump.

In addition, as shown in FIG. 2, a portion of the passage 56, preferably the bend 58, is enlarged relative to other portions thereof. In this manner, the enlarged portions of the passage 56 reduce flow restriction, and, thus, reduce any potential throttling of the fluid F above the stem 44. In addition, the increased area serves as a pocket or cushion to smooth out pressure fluctuations.

Separately, also as shown in FIG. 2, a bumper 74 may be mounted to the top edge 50 of the stem 44. The bumper 74 is elastically deformable to respond to pressure applied thereto by the fluid F. The bumper 74 can be a hollow dome-shaped member which protrudes from the stem 44, or, alternatively, can be a solid pellet or ball which is partially inserted into the stem 44 and extends therefrom. The bumper 74 will absorb some of the pressure fluctuations in the fluid F and immunize the operation of the pump 10 there against.

Referring again to FIG. 1, a ratchet tooth 76 may be formed on the piston 40 to bear against the stem 44. The ratchet tooth 76 is plate shaped with a generally triangular profile. The bearing of the ratchet tooth 76 against the stem 44 creates friction which inhibits relative movement between the stem 44 and the piston 40. Again, the inhibition of movement of the stem 44 serves to limit the effect of pressure fluctuations. A plurality of ratchet teeth 76 may also be provided.

Figure 3:
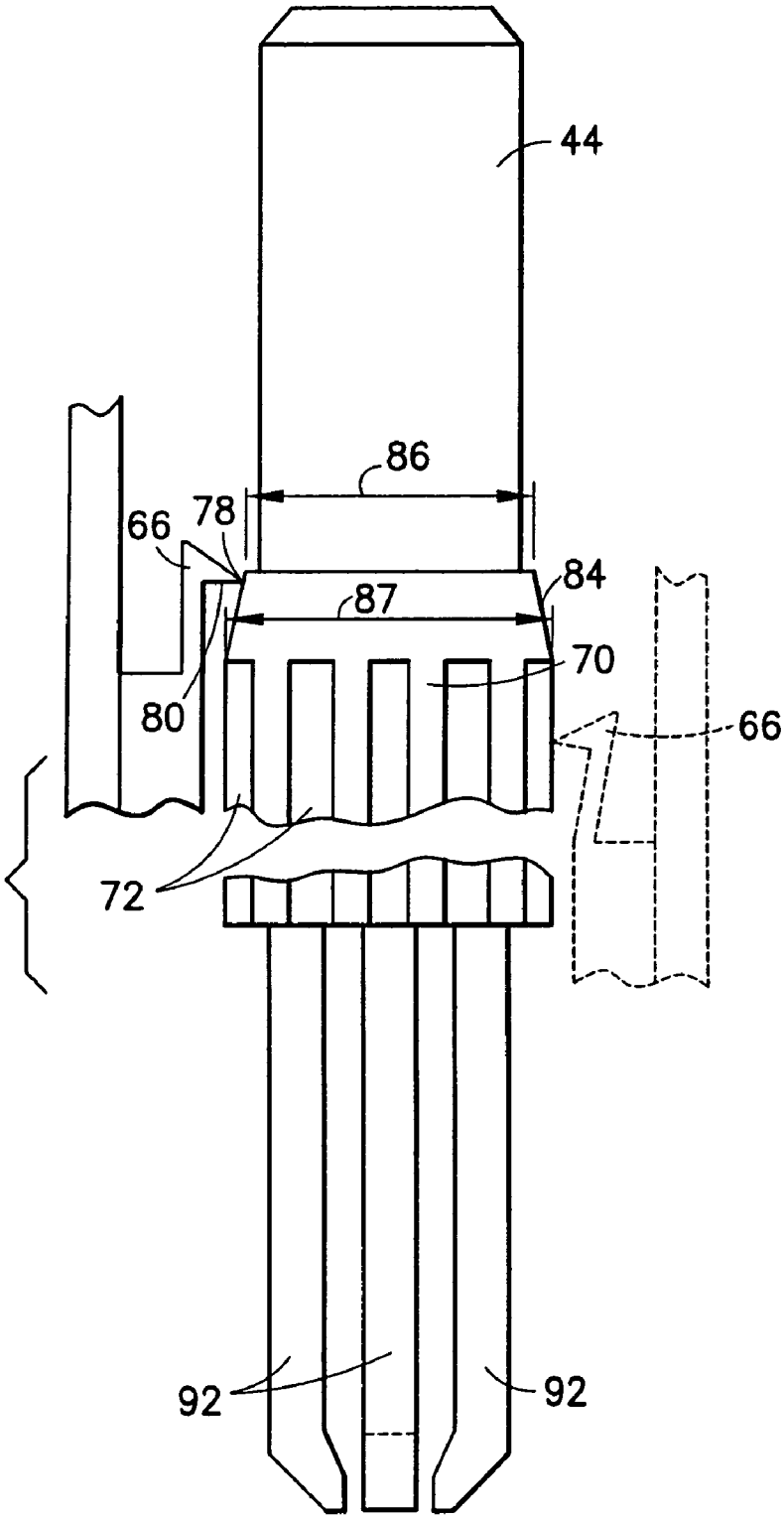
FIG. 3 is an enlarged view of an alternative stem of the pump.

Furthermore, with reference to FIG. 3, the annular seal 66 may be formed with a generally right-triangular cross-section, having a pointed edge 78 for engaging the stem 44. With this structural arrangement, a generally planar lower surface 80 is defined which is generally perpendicular to the axis of the stem 44. This perpendicular arrangement creates more fluid drag during use against upward movement of the stem 44, thereby inhibiting the movement of the stem 44 and further reducing the effects of pressure fluctuations.

Figure 4:
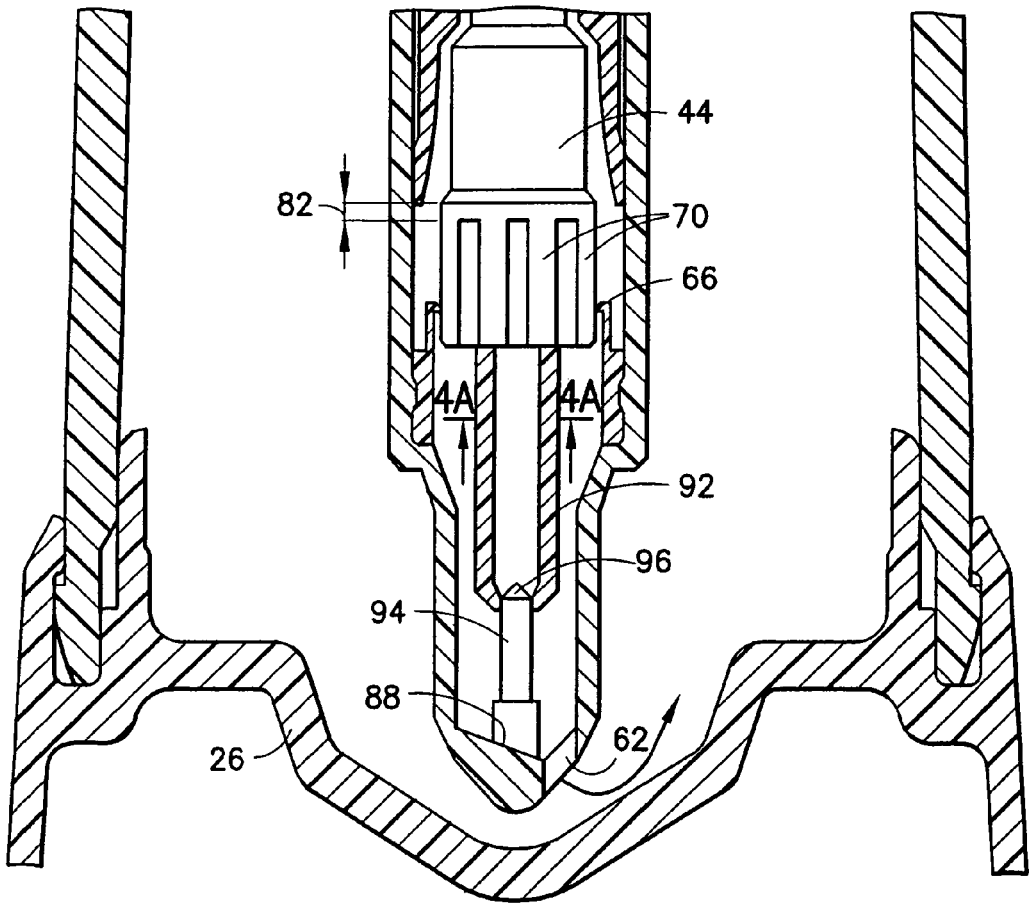
FIG. 4 is an enlarged view of the stem.

Typically in the pump art, a seal in a seal/shaft arrangement is sized so that the seal diameter is a little smaller than the shaft to ensure a good seal. Often, the seal is 0.010 inches smaller than a shaft diameter in seals typically used in hand-held pre-compression pumps, such as the annular seal 66. Referring to FIG. 4, a constant-diameter portion 82 is formed in the stem 44 above the splines 70 which may be 0.010 inches larger than the inner diameter of the annular seal 66. Alternatively, as shown in FIG. 3, the constant-diameter portion may be substituted for by conical portion 84. The conical portion 84 is preferably made with an upper diameter 86 slightly greater, e.g. 0.002 inches, than the inner diameter of the annular seal 66. Also, preferably a lower diameter 87 is provided of 0.005 inches. The conical portion 84 provides a progressively looser fit in the seal 66 as it progresses down through the seal 66 with the movement of the stem 44, thereby allowing the stem 44 to move downwards with less resistance from the seal 66 throughout the dispensing stroke. This reduction in resistance from the seal 66 reduces the creation of pulses.

Priming

The elimination of air pockets and bubbles, especially upon initial use of the pump 10 is critical to ensure proper priming is achieved, especially where microdoses are concerned.

Most prior art pump dispensers house fluid to be dispensed at the bottom of the dispenser; the dispenser then pulls, or lifts, the fluid upwards via a dip tube which dips into the liquid. In contrast, the pump 10 houses the fluid F around the cylinder 30 and does not utilize a dip tube. Instead, the inlet 62 is in direct communication with the fluid reservoir 28. As shown, the inlet 62 may be coextensive with the cylinder 30, or may be formed to extend slightly therefrom. Costs are saved by removing the dip tube component. Also, priming is enhanced, because the fluid F is disposed at a higher elevation with respect to the cylinder 30 as compared to the elevation of fluid in prior art pumps utilizing dip tubes. With the subject invention, the fluid F at least partially engulfs the stem 44 with the cylinder 30 substantially being coextensive with the fluid reservoir 28 and the inlet 62 being located in proximity to the bottom wall 26.

The recesses 72 allow air to leak freely out of the cylinder chamber 64 during priming. The splines 70 are relatively shallow, preferably 0.001 to 0.005 inches, which allows air to pass downwards with the pump 10 not in use. The annular seal 66 is disposed about the splines 70 with the pump 10 not in use. In addition, because of the shallowness of the splines 70, fluids will be generally too viscous to pass through the recesses 72, and, thus, will remain above the seal 66 in an unactuated state. In re-charging the cylinder chamber 64 after a dispensing operation, the fluid F is urged through the recesses 72 under force of the aforementioned pressure differential.

Additionally, as shown in FIG. 1, it is preferred that the inlet 62 be located off-center in the lower end 48 of the cylinder 30. Preferably, the inlet 62 will be located off-center in a direction away from the nozzle 60. Since the pump 10 will often be inclined slightly towards the nozzle 60 in use, the off-center location will encourage entrapped air to be expelled into the fluid reservoir 28, where it can rise freely up to the vent holes 38.

Furthermore, the inside surface 88 of the lower end 48 is preferably inclined, relative to the cylinder 30, so as to encourage the fluid F to spread evenly across the inside surface 88 upon entry. This ensures that pockets of air do not become trapped at this point.

Figure 5:
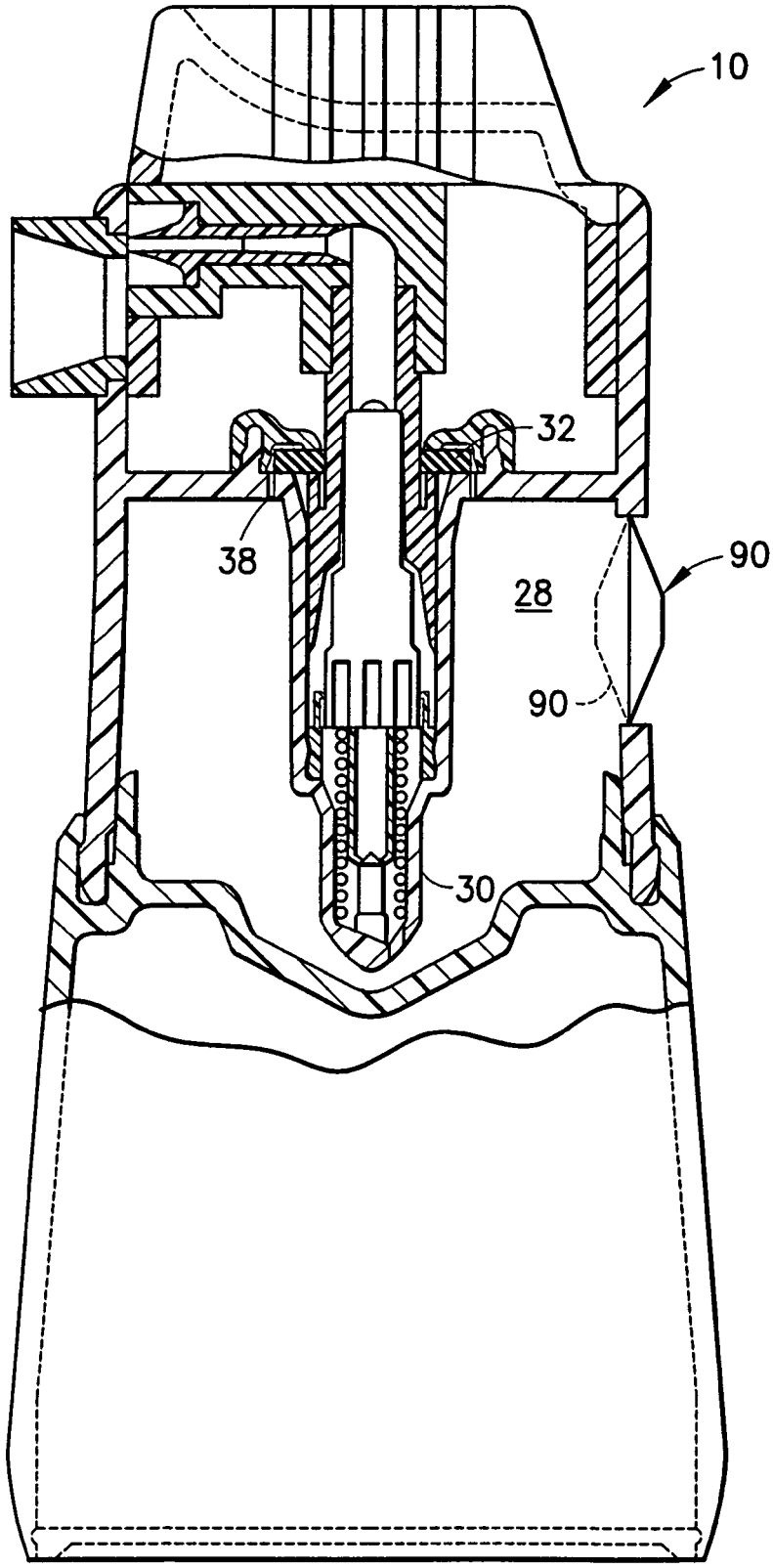
FIG. 5 is an elevational view of the pump with a deflectable diaphragm.

As yet another additional feature, the pump 10 of the subject application can be provided with a deflectable diaphragm 90 for accelerating the priming operation. Currently, prior art pumps prime themselves prior to dosing liquid by stroking up and down several times. Once fully flooded with liquid they then begin to dose. The problem with very low dose pumps (any below 70 micro-liters) is that the number of strokes required to prime can be high, simply because the internals of the pump are of relatively high volume compared to the dose volume of the pump. Referring to FIG. 5, the diaphragm 90 protrudes from the outer wall 16 prior to initial use of the pump 10. Instead of priming the dispenser by pressing the cap several times, the user presses the diaphragm 90, which deflects inwards into the fluid reservoir 28 and remains in that position. The indenting of the diaphragm 90 decreases the volume of the fluid reservoir 28, thereby raising the pressure in the fluid reservoir 28 which spontaneously drives the fluid F into the cylinder 30. In order for the fluid F to be driven into the cylinder 30, the stem/piston interaction of the top edge 50 and the lip 52, when in a dry condition, and allowing air in the pump 10 to pass therethrough. It should be noted that the rubber washer 32 should not leak at a lower pressure than the stem/piston interaction because the deflection of the diaphragm 90 would result in fluid leaking through the vent holes 38, without the pump 10 being actually primed.

Sufficient Operating Momentum

The basic operation described above is sufficient to dispense fluid out of the pump 10. But, if the pump 10 is operated very slowly, it is possible to dispense the fluid F so slowly that it dribbles down the outside of the nozzle 60 instead of leaping clear of the nozzle 60 as is desired for reliable operation. U.S. Pat. No. 5,881,956 describes a latch mechanism which is utilized to ensure a minimum amount of velocity is applied to actuate a pump. The pump 10 is also provided with a mechanical latch in the form of a plurality of fingers 92 which are cantilevered to, and extend downwards from, the stem 44. The fingers 92 bear against and slide freely against an upstanding pin 94 during downward movement of the stem 44 and the piston 40. In an unactuated state of the pump 10, it is preferred that the fingers 92 be located clear of and above the pin 94.

The pin 94 has a tapered end 96, with increasing diameters from smaller to larger. Preferably, the end 96 makes initial contact with the fingers 92 just prior to the point at which the upper end of the splines 70 on the stem 44 enter the seal 66 (which is the point at which the pump is about to dispense fluid).

The point at which the fingers 92 engage the tapered end 96 may be slightly in advance of the point at which the splines 70 enter the seal 66. To further advance the stem 44 downwardly, sufficient force must be applied to deflect the fingers 92 and cause yielding thereof. The increased downward force required to deflect the fingers 92 past the tapered end 96 provides sufficient momentum needed to ensure a minimum velocity is provided to the pump 10 to properly dispense a full dose of the fluid at an acceptable velocity.

Cleanliness

With respect to another aspect of the invention, to achieve reliable and safe dosing of fluid, the nozzle 60 and free space around the nozzle cap 14 must remain clean and free from any accumulation of excess fluid, or the dried remnants of fluid.

Cleanliness of the nozzle 60 may be managed in several ways.

Figure 6:
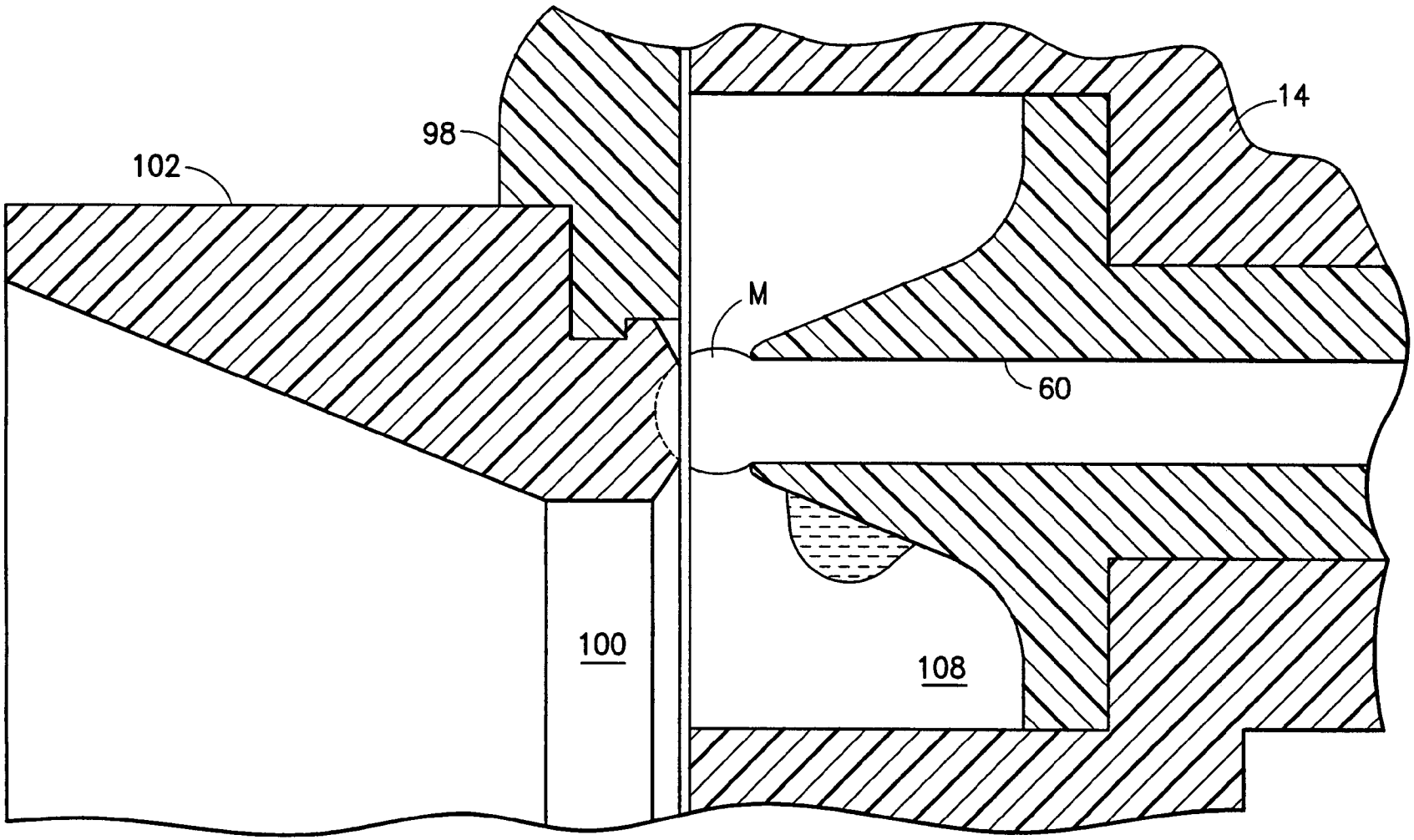
FIG. 6 is an enlarged view of the nozzle of the pump.
Figure 7:
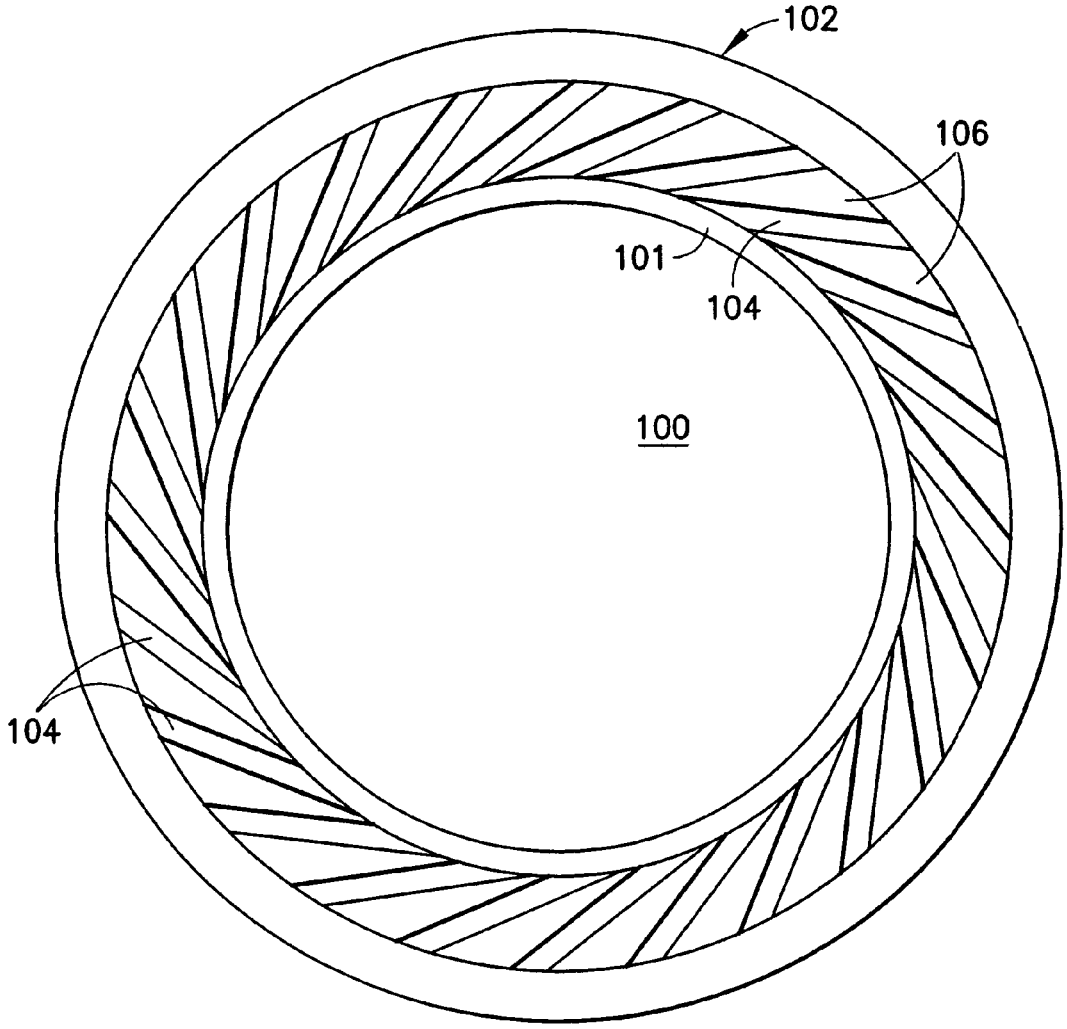
FIG. 7 is an elevational view of the portion of the shroud about the dispensing opening in the shroud.
Figure 8:
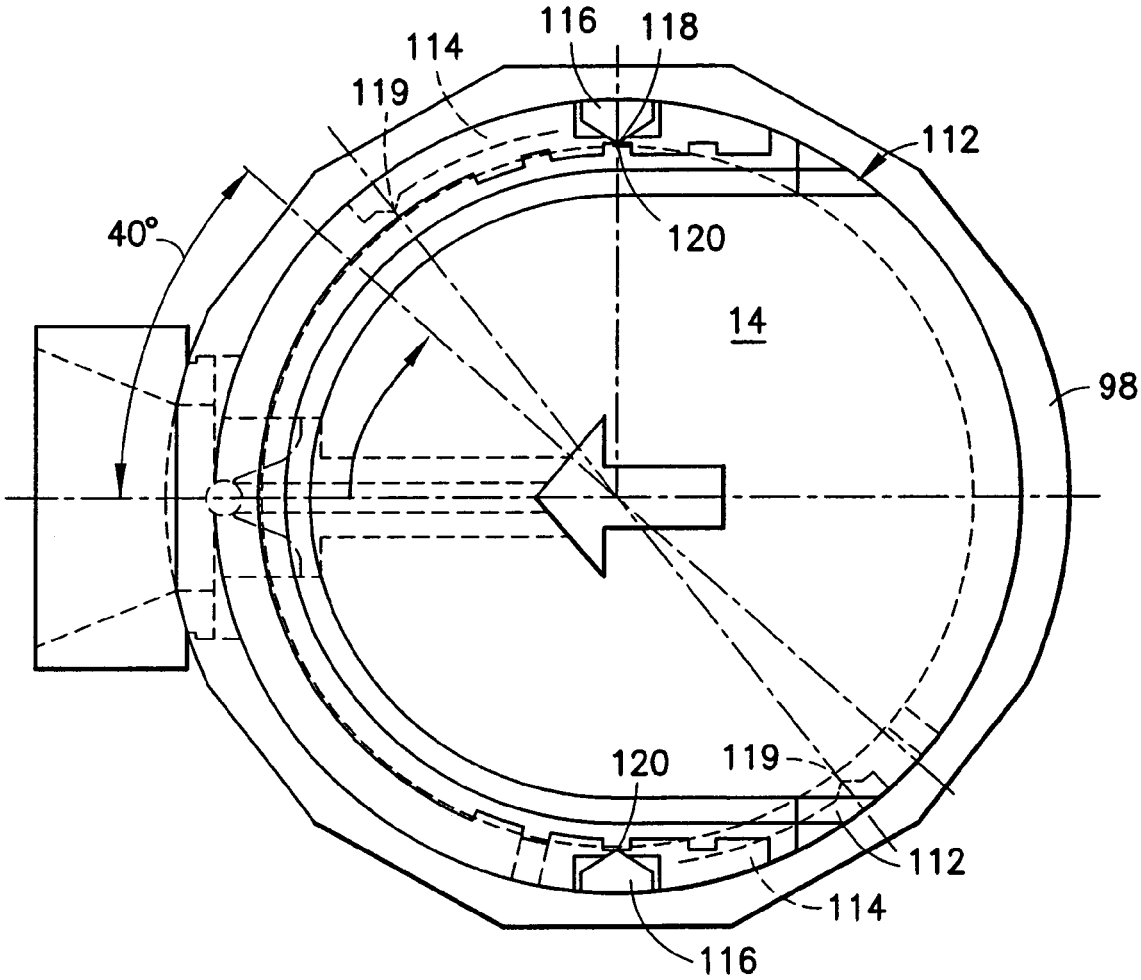
FIG. 8 is a top view showing the locking and operating positions of the nozzle cap; and, FIG. 9 is a plan view of the sealing members.
Figure 9:
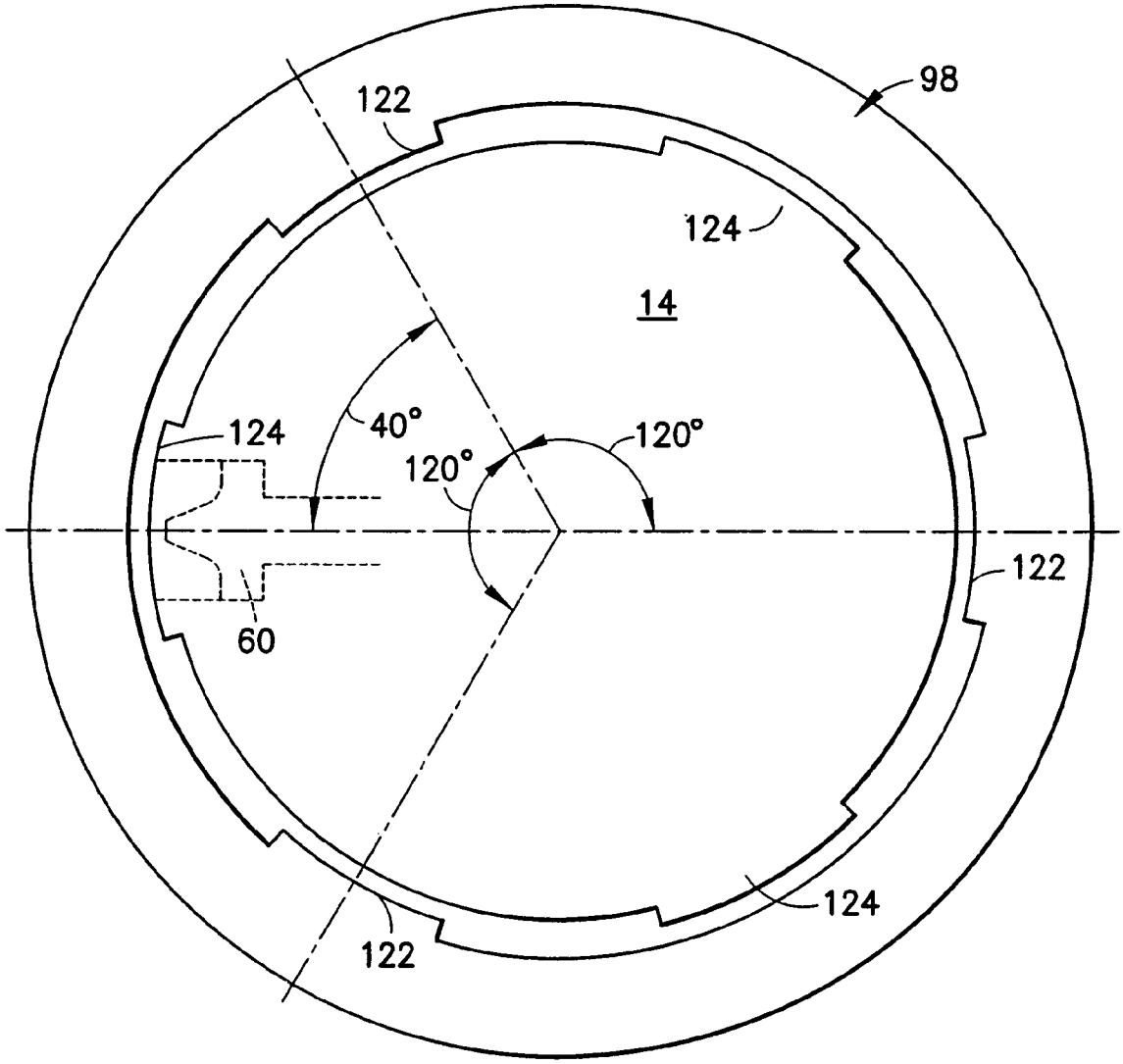

The portion of the outer wall 16 disposed about the upper chamber 20 defines a shroud 98 which shields the nozzle cap 14 and the nozzle 60 from dirt and debris. A dispensing opening 100 is defined in the shroud 98 which is located to register with the nozzle 60 during dispensing, so that dispensed fluid may pass through the shroud 98. When the pump 10 is not in use, and is in a rest position, the nozzle 60 is positioned behind a portion of the shroud 98. The nozzle 60 is disposed to be relatively close to a snout 102 formed about the opening 100. The snout 102 is used to aim the pump 10 when in use. The nozzle 60 is brought close enough to the snout 102 so that any liquid meniscus M which might remain on the nozzle 60 after dosing is wiped against the snout 102. As shown in dashed lines in FIG. 6, the meniscus M overlaps with portions of the snout 102. The wiping action has the tendency to transfer some of the excess fluid onto, or adjacent to, the shroud 102, thus reducing the height of the meniscus M. It is preferred that the liquid be transferred to the snout 102, rather than to other portions of the pump 10.

When the pump 10 is not in use, the nozzle cap 14 is rotated, preferably by about 40 degrees, into a locking position to prevent inadvertent operation. During this locking operation, any slight meniscus of liquid which might have gathered will not be wiped around the inside of the shroud 102 which surrounds the cap 14 because of the prior wiping action against the inside of the snout 102.

A further embellishment to encourage liquid to transfer from the nozzle 60 to the snout 102 is provided by a series of angled cuts 104 on the inside face 101 of the snout 102. These cuts 104 are angled such that tapered lands 106 are defined which accommodate the excess liquid on the snout 102. The lands 106 diverge and becomes broader, and as the cap 14 is rotated to a lock position, the nozzle 60 wipes past the broadening region of a land 106. The broadening land 106 tends to pull the liquid outwards to its boundaries, defined by the cuts 104, which draw more liquid away from the nozzle 60 as the cap 14 is rotated to the locked position. Also, the cuts 104 act to break surface tension of the meniscus M, as the meniscus M is passed thereover.

Given that the inside of the snout 102 wipes the meniscus M on the nozzle 60, some of the excess liquid may partly transfer onto the snout 102, but can also be pushed downwards from the mouth of the nozzle 60 and roll over and down the outside of the protruding nozzle. A void 108 is provided around the nozzle 60 where any excess liquid can be transferred. In this way, the excess fluid can dry without interfering with the mouth of the nozzle 60.

To further encourage any meniscus M to roll over and onto the outside conical section of the nozzle 60 and be deposited within the void 108 defined about the nozzle 60, the front edge of the nozzle is rounded with a full radius, of typically 0.005 inches. This small radius tends to reduce any meniscus formation by encouraging the rolling over mechanism to occur.

As a further embellishment to all the features mentioned above regarding meniscus elimination, all the surfaces which are designed to receive excess liquid from the nozzle 60 can be roughened during manufacture, on the basis that roughened surfaces will more readily attract liquid.

As previously mentioned the cap 14 is rotated relative to the body 12 of the pump 10 in order to lock it against unintended operation. To facilitate rotation, grooves 110 are cut into the outside of the cap 14 to provide a grip to provide for this rotation. The pump 10 provides for the outer surfaces of these grooves 110 to be roughened to improve the quality of the grip.

The rear part of the cap has flat faces 112 which can also be used to rotate the cap 14 into and out of its locked position. Pushing on one of the faces 112 will rotate the cap to lock, while pushing on the other face 112 will rotate the cap to unlock.

A pair of slotted faces 114 cut into the outside diameter of the cap 14 work in conjunction with a pair of protrusions 116 on the inside diameter of the shroud 98 to define the position at which the cap is permitted to descend and also the extremes of rotational travel of the cap 14. A detent 118 is added to each of the protrusions 116 within the shroud 98 which is formed to snap into a groove 118 when the cap 14 is rotated into the lock position. The detents 118 indicate that the lock position has been achieved by holding the cap 14 in that position. Similar shaped grooves 120 are formed to correspond to the operating position of the cap 14, thus providing clear indications as to the locked and operating positions.

Once the locked position is achieved it is desirable to provide an intimate seal between the periphery of the cap 14 adjacent to the nozzle 60 and the inside of the shroud 9B. This is achieved by introducing three bands 122 of reduced diameter on the inside of the shroud 98, preferably equi-spaced, and three bands 124 of increased diameter on the cap 14, also preferably equi-spaced. One of the bands 124 on the cap 14 is preferably centered upon the nozzle 60. The diameters of the inside bands on the shroud 122 and outside bands 124 on the cap 14 are approximately equal in diameter, to provide a seal when overlapped. It is preferred that the overlapping occur when the pump 10 is locked, with the bands of the cap 124 being in pressing engagement with the bands of the shroud 122, preferably with transition fits. When the pump 10 unlocked and the cap 14 is urged into an operating position, the diameter bands on the shroud 122 and the cap 124 are spaced apart to allow unrestricted downward operation of the cap 14.

Handle

Since the fluid reservoir 28 is generally coextensive with the cylinder 30, the overall length of the pump 10 is relatively short. Accordingly, a handle H is provided for convenient handling and gripping. The handle H both provides an ergonomic grip for the user and also serves to buffer the fluid reservoir 28. Preferably, the pump 10 will be filled in an inverted position, and the handle H will be snapped into place. The pump 10 will then be inverted to the normal upright position for further manufacturing operations.

The discussion set forth above is with respect to a pre-compression pump. Those skilled in the art will understand that the disclosure herein is exemplary and the inventive features may be applied to other types of pumps.

The invention is not intended to be limited to the embodiments discussed herein, but only limited by the scope of the appended claims.

What is claimed is:

1. A pump for dispensing fluid, said pump comprising:

a pump body; an elongated stem slidably disposed in said pump body, said stem having a plurality of cantilevered fingers extending therefrom; and, a pin disposed in said pump body, wherein said pin is located to be contacted by said fingers upon a predetermined extent of sliding movement of said stem, said fingers flexing upon contacting said pin such that said pin yieidingly inhibits movement of said stem, wherein a predetermined amount of force is required to overcome the inhibition of movement of said stem so as to enable further movement of said stem and operation of the pump.

2. A pump as in claim 1, wherein said fingers are circumferentially spaced about an end of said stem.

3. A pump as in claim 2, wherein said fingers are evenly spaced.

4. A pump as in claim 1, wherein said pin has a tapered end which is initially contacted by said fingers.

5. A pump as in claim 1, wherein said pin has a constant diameter portion.

6. A pump as in claim 1, wherein said fingers are disposed to contact said pin and flexing outwardly upon yielding.

7. A pump as in claim 6, wherein said fingers are inherently biased to press against said pin after yielding.

* * * * *

UNITED STATES PATENT AND TRADEMARK OFFICE

CERTIFICATE OF CORRECTION

PATENT NO. : 7,207,468 B2
APPLICATION NO. : 11/296974
DATED : April 24, 2007
INVENTOR(S) : Cohen et al.

It is certified that error appears in the above-identified patent and that said Letters Patent is hereby corrected as shown below:

At the Title page, in the Abstract, line 9, replace "assist in printing the pump" with --assist in priming the pump--.

At column 1, line 2, replace "10/069,682, filed Mar. 7, 2002, now" with --10/069,682, filed Aug. 7, 2002, now--.

At column 9, line 28, replace "of the shroud 9B" with --of the shroud 98.--

Signed and Sealed this

Thirty-first Day of July, 2007

JON W. DUDAS
*Director of the United States Patent and Trademark Office*